US007857150B2

(12) United States Patent
Young

(10) Patent No.: US 7,857,150 B2
(45) Date of Patent: Dec. 28, 2010

(54) LIGHTWEIGHT CARRIER FOR GOLF CLUBS

(76) Inventor: Michael R. Young, 2754 N. 127th St. East, Wichita, KS (US) 67226

( * ) Notice: Subject to any disclaimer, the term of this patent is extended or adjusted under 35 U.S.C. 154(b) by 280 days.

(21) Appl. No.: 11/957,552

(22) Filed: Dec. 17, 2007

(65) Prior Publication Data

US 2009/0152220 A1 Jun. 18, 2009

(51) Int. Cl.
*A63B 55/00* (2006.01)

(52) U.S. Cl. ..... 211/70.2; 206/315.6; 206/315.7; 206/315.2; 211/60.1

(58) Field of Classification Search ..... 211/70.2, 211/14, 60.1, 62, 70.8; 206/315.2, 315.3, 206/315.6, 315.7; 248/96; D6/255; 294/143, 294/146, 159

See application file for complete search history.

(56) References Cited

U.S. PATENT DOCUMENTS 1,418,093 A * 5/1922 Parmater ..... 211/15
3,866,646 A * 2/1975 Nevard ..... 211/70.2
4,936,598 A * 6/1990 Lee ..... 280/645
5,314,079 A * 5/1994 Young ..... 211/70.2
5,417,334 A * 5/1995 Wu ..... 211/70.2
5,451,072 A * 9/1995 Weng ..... 280/646
5,474,191 A * 12/1995 Bergeron et al. ..... 211/70.2
6,737,498 B2 * 5/2004 Harris et al. ..... 528/85
7,284,659 B2 * 10/2007 Sugarek et al. ..... 206/315.6

* cited by examiner

*Primary Examiner*—Darnell M Jayne
*Assistant Examiner*—Patrick Hawn
(74) *Attorney, Agent, or Firm*—Hovey Williams LLP

(57) ABSTRACT

A lightweight carrier for golf clubs adapted for substantially upright positioning on the ground when not being carried, including a hollow tubular support that duals as a golf ball holder, a handle affixed near the top of the tubular support or at some point along the tubular support, a club holder top affixed near the top of the tubular support or at some point along the tubular support, a club holder base affixed at or near the bottom of the tubular support, one or more pins extending substantially axially from the base adapted to penetrate into the ground and support the carrier in an upright position when not being carried, and a pin cover to cover the pins while the carrier is being carried.

10 Claims, 6 Drawing Sheets

LIGHTWEIGHT CARRIER FOR GOLF CLUBS

BACKGROUND OF THE INVENTION

1. Field of the Invention

The present invention relates generally to a golf club holder and carrying device. More particularly, the present invention relates to a golf club holder and carrying device that may be maintained in an upright position on the ground.

2. Description of Related Art

Present day golfing typically involves the transportation of heavy golf bags carried over the shoulder, by means of electric carts, hand pulled carts, or caddies. Short cuts through various terrain that a golfer may find convenient are frequently not available because transporting a golf bag can be difficult. Moreover, it is frequently the case that a golfer wishes to play a more casual extemporaneous round, perhaps just a few holes, and therefore has no desire for carts or caddies. In such an event, the golfer may wish to use a reduced number of clubs in a lightweight bag that can be carried without onerous physical effort and through areas that would be difficult to traverse. Even the use of a lightweight bag has its drawbacks, one of which is that the bag is usually placed on the ground after a club has been selected. This often results in the club heads banging against each other or against the ground and becoming damaged or scratched. Additionally, the club heads or head covers and the bag frequently become soaked and coated by wet grass, leaves, twigs, and other flora of the course. Bending over and picking up a golf bag can also, for some people, be a bothersome task. Tri-pod golf bags have the benefit of not being placed (or thrown) on the ground, but they do not prevent club heads from banging around with each other and becoming damaged or scratched.

BRIEF SUMMARY OF THE INVENTION

The present invention relates to a golf club holder and carrying device that may be maintained in an upright position on the ground and that accessibly and conveniently holds devices normally used while playing a round of golf: clubs, balls, tees, and tools. An object of the invention is to provide a carrying device, particularly adapted to carrying golf clubs and golf equipment, wherein the device has minimum weight, is easy to handle and carry, particularly over difficult terrain, and can be readily positioned and secured to the ground in upright position by ground penetrating pins whereby the clubs, balls, tees, and tools are supported by the carrier and kept off of the ground and highly accessible. Another object of the invention is to provide a device that minimizes club heads rattling together against one another and becoming damaged or scratched. Another object of the invention is to provide such device with an easily opened locking pin cover or shielding device for said pins for safety purposes. Another object of the invention is to provide such device with a pin cover that once unlocked, may be withdrawn by dragging the leading edge of the pin cover over the ground thereby not requiring additional operation by the golfer to retract the cover.

BRIEF DESCRIPTION OF THE SEVERAL VIEWS OF THE DRAWING

A preferred embodiment of the present invention is described in detail below with reference to the attached drawing figures, wherein.

DETAILED DESCRIPTION OF THE INVENTION

The embodiments discussed herein are merely illustrative of specific manners in which to make and use the invention and are not to be interpreted as limiting the scope of the instant invention.

While the invention has been described with a certain degree of particularity, it is to be noted that modifications may be made in the details of the invention's construction and the arrangement of its components without departing from the spirit and scope of this disclosure. It is understood that the invention is not limited to the embodiments set forth herein for the purposes of exemplification.

Figure 1:
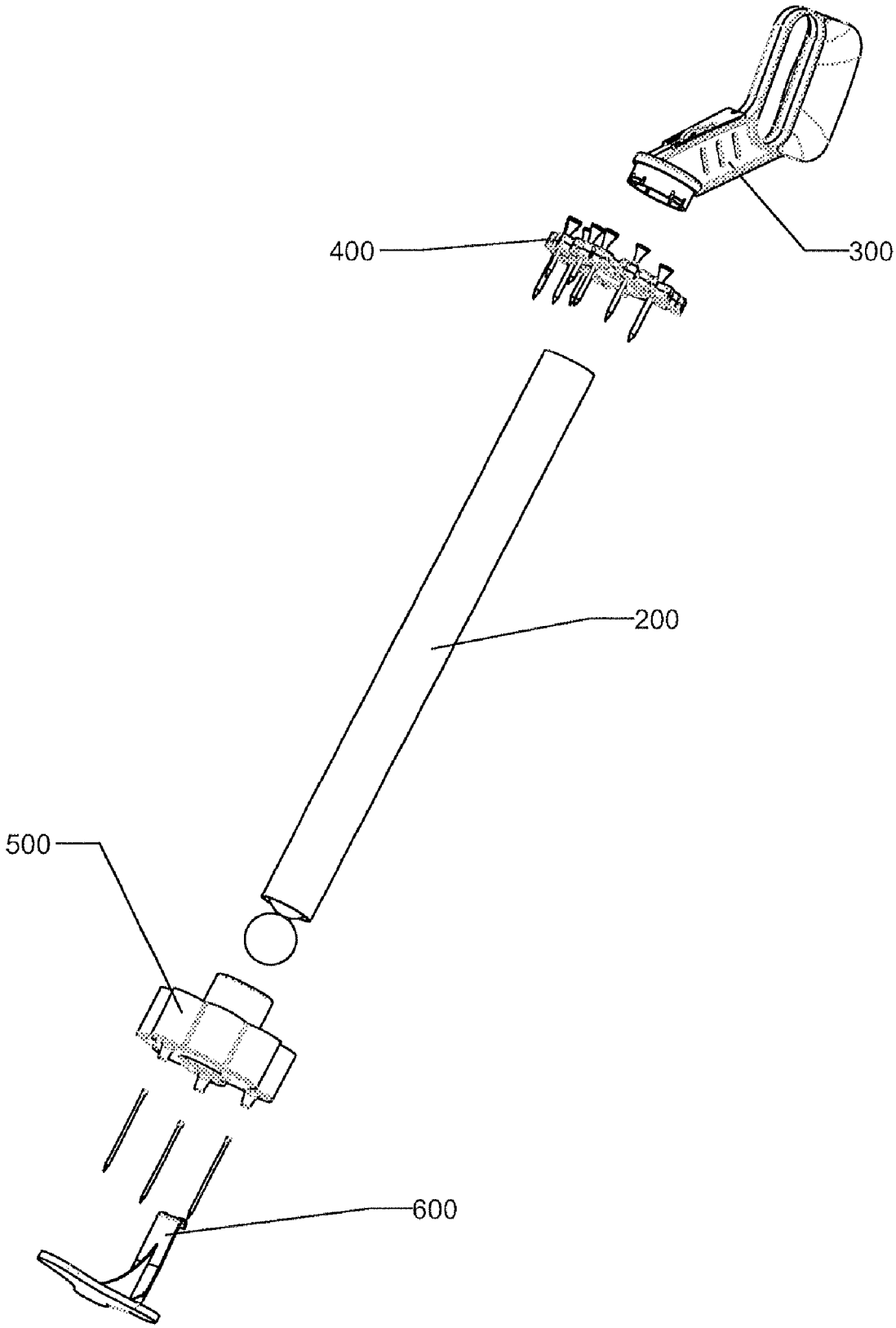
FIG. 1 illustrates an exploded isometric view of one embodiment of the invention.

Referring to the drawings in detail, FIG. 1 illustrates an exploded isometric view of one embodiment of the invention. A hollow tubular support member 200, with a handle 300 that attaches at or near the upper end of the hollow tubular support member 200. A club holder upper base 400 attaches to the handle, and a club holder lower base 500 attaches at or near the lower end of the hollow tubular support member with pins that extend therefrom. A pin cover 600 attaches to the club holder lower base and covers the pins when the device is not resting in the ground.

Figure 2A:
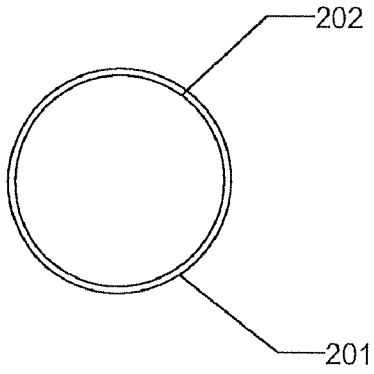
FIG. 2*a* illustrates an end view of one embodiment of the hollow tubular support member.
Figure 2B:
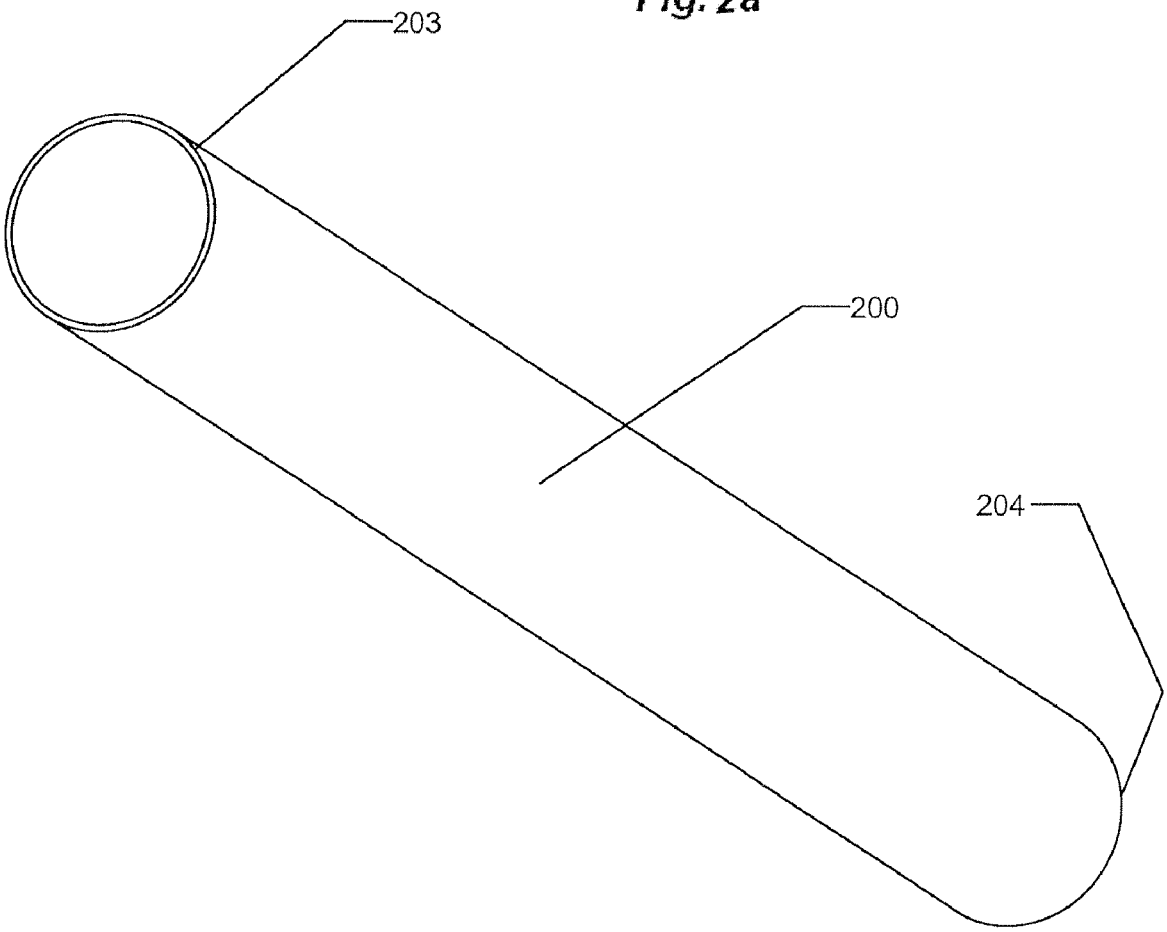
FIG. 2*b* illustrates an isometric view of one embodiment of the hollow tubular support member.

FIGS. 2*a* and 2*b* illustrate one embodiment of the hollow tubular support member 200. The hollow tubular support member includes an outer surface 201, an inner surface 202, an upper end 203, and a lower end 204. The hollow tubular support member may be made of plastic, metal, wood, or any other appropriate material capable of achieving the desired form. In the preferred embodiment, the hollow tubular support member is composed of acrylonitrile butadiene styrene (hereinafter ABS). The hollow tubular support member may have a length of between 12 inches and 40 inches, and an inner diameter of between 1.00 inches and 2.00 inches. In the preferred embodiment, the hollow tubular support member has a length of 20.25 inches, an inner diameter of 1.71 inches, and an outer diameter of 1.817 inches.

Figure 3A:
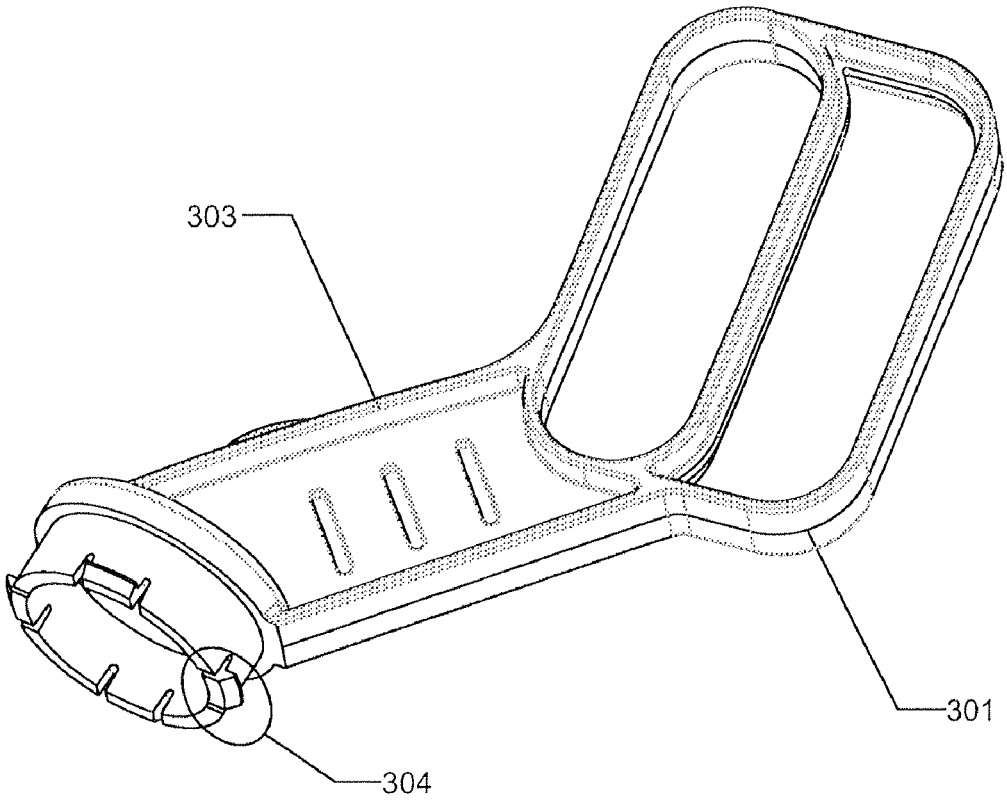
FIG. 3*a* illustrates an isometric view of one embodiment of the handle.
Figure 3B:
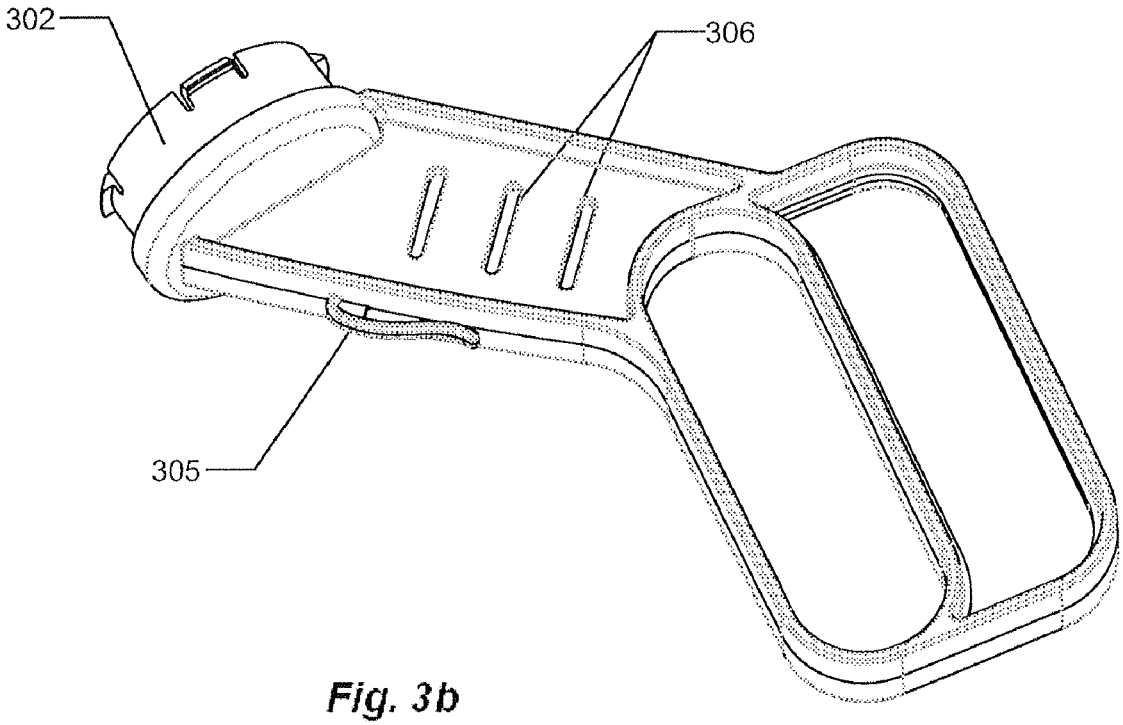
FIG. 3*b* illustrates another isometric view of the handle of FIG. 3*a*.

FIGS. 3*a* and 3*b* illustrate one embodiment of the handle 300. In the preferred embodiment, the handle includes a handle grip 301, and a handle base 302 connected by an intermediary handle support 303. The handle may be made of plastic, metal, wood, or any other appropriate material capable of achieving the desired form. In the preferred embodiment, the handle is composed of ABS. The handle base 302 is a short hollow tube with an inner surface having an inner diameter slightly smaller than the outer diameter of the hollow tubular support member. In the preferred embodiment, the handle base has an inner diameter of 1.815 inches, and an outer surface having an outer diameter of 2.13 inches. In the preferred embodiment, the handle base includes notched flexible fasteners 304. The club holder upper base 400 is attached to the handle base and locked into place by sliding the club holder upper base over the notched flexible fasteners. In the preferred embodiment, the handle has a means for detachably attaching golf tools thereon. This means may be in the form of clips 305 located on the intermediary handle support, or narrow slits 306 located within the intermediary handle support. In the preferred embodiment, the handle is attached or fused to the upper end of the hollow tubular support member by the use of an adhesive or any other appropriate means. In an alternate embodiment, not shown, the handle may be attached to the hollow tubular support member by interlocking threads located on the inner surface of the handle base with corresponding threads located on the upper end of the hollow tubular support member.

Figure 4A:
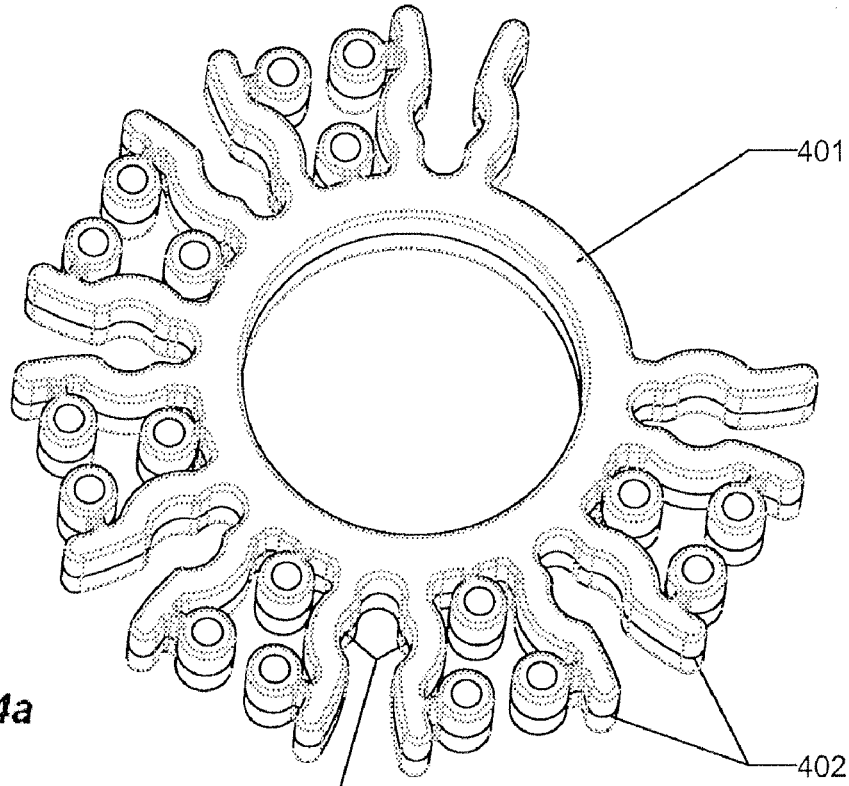
FIG. 4*a* illustrates a top view of one embodiment of the club holder upper base.
Figure 4B:
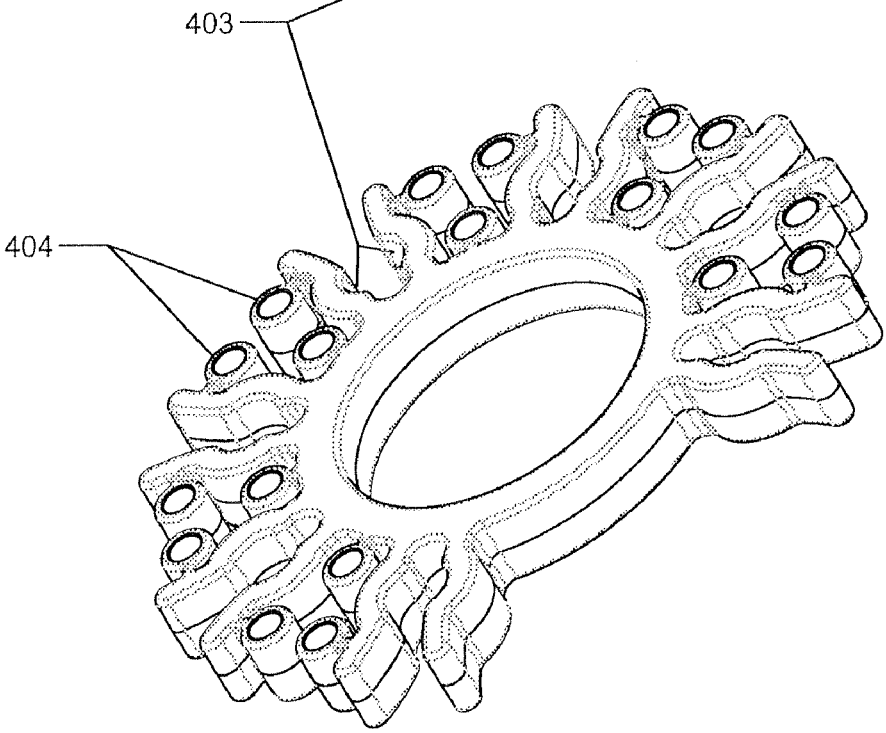
FIG. 4*b* illustrates an isometric view of one embodiment of the club holder upper base.

FIGS. 4*a* and 4*b* illustrate one embodiment of the club holder upper base 400. In the preferred embodiment, the club holder upper base is comprised of a ring shaped base 401 with an inner diameter of approximately 2.130 inches. A plurality of flexible pinchers 402, adapted to pinch and maintain the shaft of a golf club, extending radially from the ring shaped base. In the preferred embodiment, the flexible pinchers are separated by a distance of approximately 0.249 inches nearest the ring shape base and gradually widen to a distance of approximately 0.280 inches before flaring. In the preferred embodiment, the pinchers form a shaft bubble 403 of approximately 0.438 inches in diameter along the inside portion of the pinchers and between the portions of the pinchers that are separated by distances of approximately 0.249 and 0.280 inches respectively allowing the pinchers to close around and maintain the golf club shaft in a somewhat fixed position. A plurality of hollow, circular tee holders 404, with an inner diameter of between approximately 0.16 inches and 0.19 inches, are maintained on and around the ring shaped base and flexible pinchers. The club holder upper base may be made of plastic, metal, wood, or any other appropriate material capable of achieving the desired form. In the preferred embodiment, the club holder upper base is composed of Thermal Plastic Rubber.

Figure 5A:
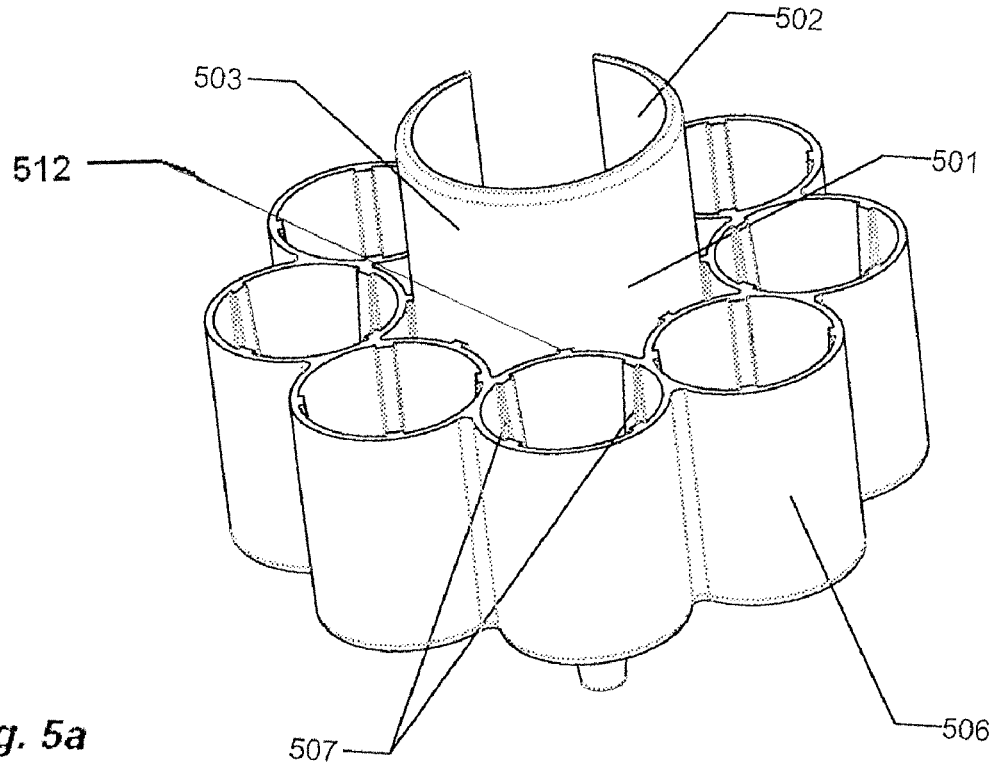
FIG. 5*a* illustrates a top isometric view of one embodiment of the club holder lower base.
Figure 5B:
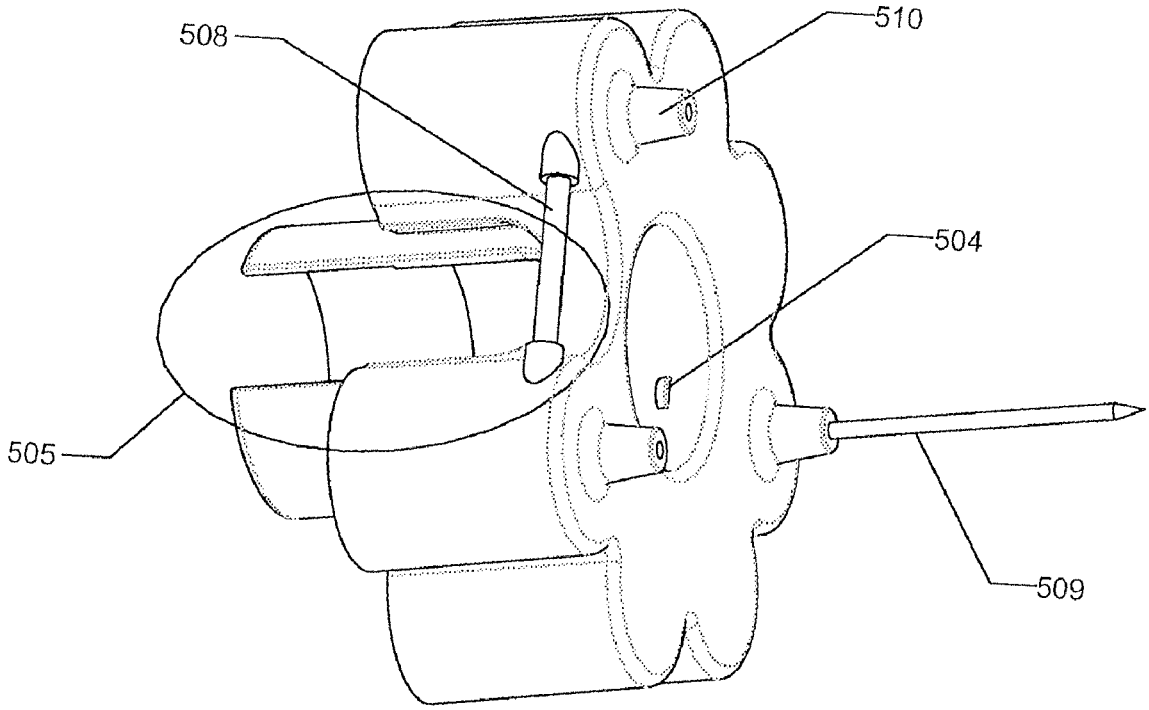
FIG. 5*b* illustrates a bottom isometric view of one embodiment of the club holder lower base.

FIGS. 5*a* and 5*b* illustrate one embodiment of the club holder lower base 500. In the preferred embodiment, the club holder lower base includes a hollow central tube 501 with an inner surface 502 and an outer surface 503. The inner surface of the club holder lower base has, at its narrowest point, an inner diameter equal to that of the inner diameter of the hollow tubular support member. The inner surface of the club holder lower base has one or more protrusions 504 located thereon used to maintain golf balls inside the hollow central tube. An opening 505 located on the side of the hollow central tube is used to manipulate golf balls held inside the hollow central tube and allow the golf balls to be forcibly removed from the tube by pushing the balls past the protrusions 504. A plurality of hollow peripheral tubes 506, each with an inner surface, outer surface, and closed bottom, are attached to the outer surface of the hollow central tube. The hollow peripheral tubes each have a plurality of protrusions 507 located on said inner surface, said protrusions tapering from wide to narrow in the direction away from the closed bottom thus allowing golf club grips of various diameters to be securely held in the peripheral tubes. Specifically, as illustrated in FIG. 5*a*, the hollow peripheral tubes 506 may each have four substantially equally-spaced protrusions 507 located on said inner surface. Furthermore, the outer surface of each of the hollow peripheral tubes 506 may be attached to the outer surface of the hollow central tube 501 at a point 512 on the outer surface of the peripheral tube located midway or approximately half way between two adjacent ones of the four protrusions 507. The hollow peripheral tubes each have an inner diameter of between 1.0 and 2.0 inches. In the preferred embodiment, the hollow peripheral tubes each have an inner diameter of 1.307 inches. A pin cover attachment bar 508 running between two fot he hollow peripheral tubes provides a point of attachment for the pin cover 600. A plurality of pins 509 are attached to and extend from the bottom of the club holder lower base; the pins may be molded into the club holder lower base, screwed into the club holder lower base, bolted onto the club holder lower base, or affixed to the club holder lower base by any other appropriate means. In the preferred embodiment, the pins are molded into the club holder lower base during the injection molding process at the points illustrated via the pin protrusions 510. The club holder lower base may be made of plastic, metal, wood, or any other appropriate material capable of achieving the desired form. In the preferred embodiment, the club holder lower base is composed of ABS. The pins may be made of steel, stainless steel, aluminum, brass, plastic, or the like. In the preferred embodiment, the pins are common stainless nails approximately 3.25 inches in length and 0.148 inches in diameter with a nail head approximately 0.30 inches in diameter.

Figure 6A:
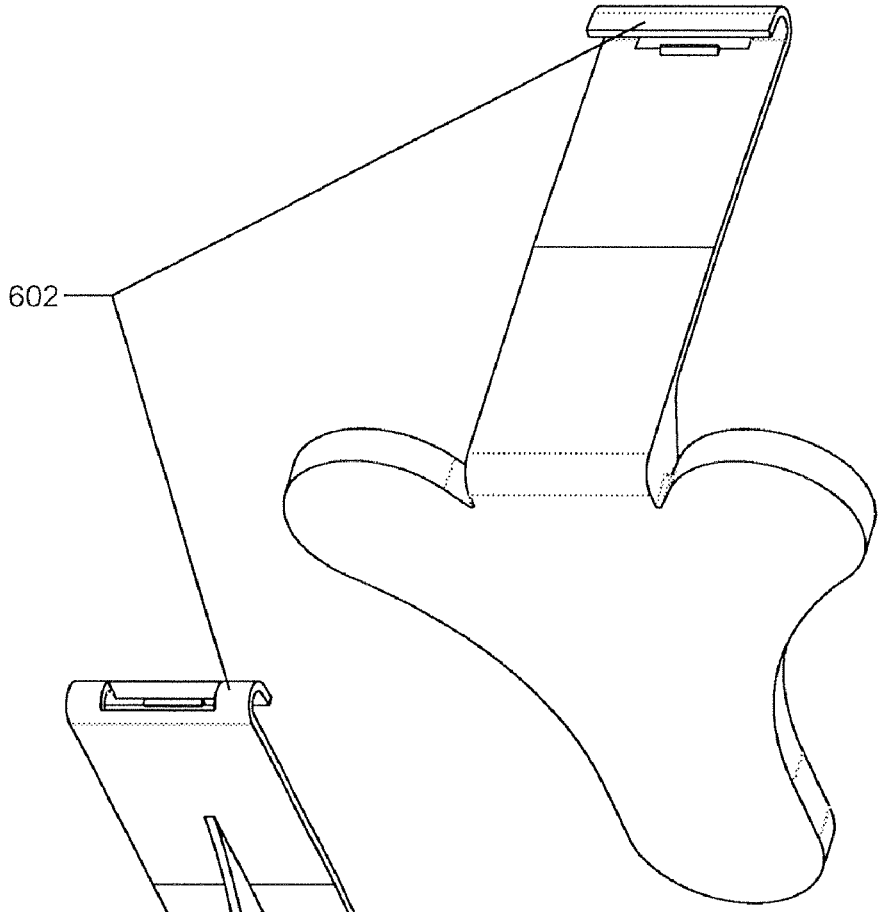
FIG. 6*a* illustrates a bottom isometric view of one embodiment of the pin cover.
Figure 6B:
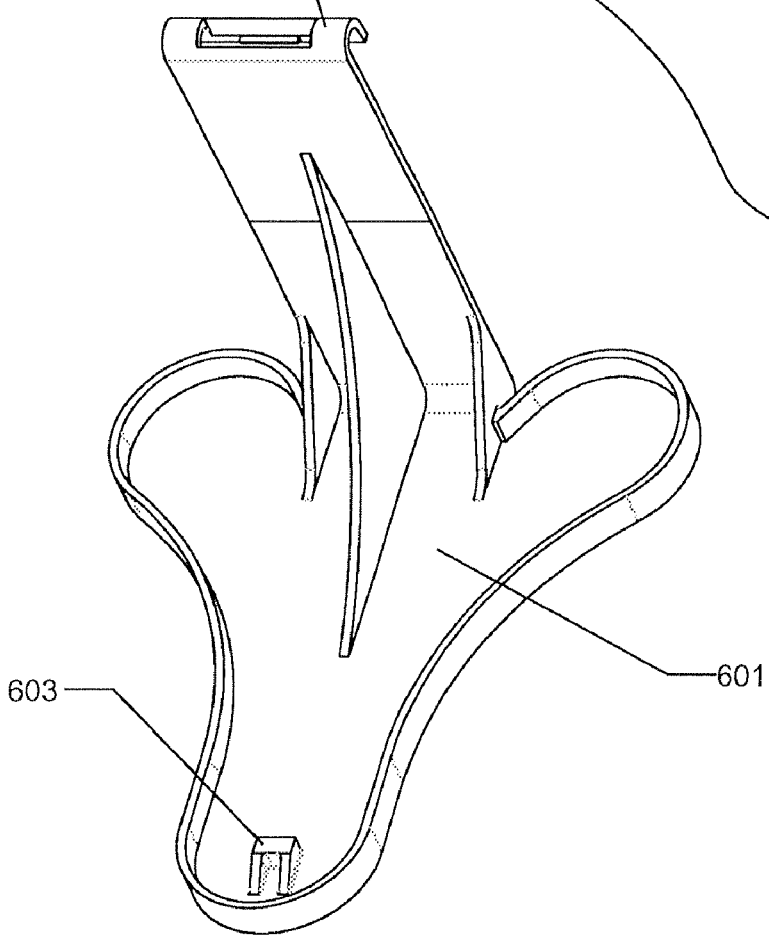
FIG. 6*b* illustrates a top isometric view of one embodiment of the pin cover.

FIGS. 6*a* and 6*b* illustrate one embodiment of the pin cover 600. In the preferred embodiment, the pin cover includes a pin cover base 601 formed to cover the pins extending from the bottom of the club holder lower base and a pin cover hook 602 adapted to detachably attach to the pin cover attachment bar 508. In the present embodiment, the pin cover locking means is at least one pin cover notch 603 adapted to snap over the tip of and rest snugly against the tip of at least one of the pins extending from the bottom of the club holder lower base. Once unlocked, the pin cover may be retracted by dragging the leading edge of the pin cover over the ground. The pin cover may be made of plastic, metal, wood, or any other appropriate material capable of achieving the desired form. In the preferred embodiment, the pin cover is composed of ABS.

The invention claimed is:

1. A golf club carrier, comprising:

a hollow tubular support member having an upper end, a lower end, an inner surface, and an outer surface;

a handle attachable to the hollow tubular support member at or near the upper end of the hollow tubular support member;

a club holder upper base attachable to at least one of the handle and the hollow tubular support member, wherein the club holder upper base comprises: a plurality of flexible pinchers arranged and spaced along a periphery of the club holder upper base and each configured to maintain a shaft of a golf club therein;

a club holder lower base attachable to the hollow tubular support member at or near the lower end of the hollow tubular support member and comprising a hollow central tube axially aligned with and attached to the hollow tubular support and a plurality of hollow peripheral tubes attached to and spaced along a periphery of the hollow central tube, each with an inner surface, an outer surface, and four protrusions located on the inner surface thereof, tapering from wide to narrow in a direction toward the club holder upper base and spaced an equal distance apart from each other, wherein each of the hollow peripheral tubes are attached to the hollow central tube at a point on the outer surface thereof approximately half way between two adjacent ones of the four protrusions; and one or more pins affixed to the club holder lower base extending substantially axially and outwardly therefrom and configured to penetrate into the ground.

2. The golf club carrier of claim 1, wherein the club holder upper base further comprises at least one tee holder extending from or attached to each of the flexible pinchers such that each tee holder is positioned between two circumferentially adjacent flexible pinchers.

3. The golf club carrier of claim 1, wherein the handle comprises clips thereon and narrow slits formed therein for attaching golf tools.

4. The golf club carrier of claim 1, wherein the club holder upper base is made out of thermal plastic rubber.

5. The golf club carrier of claim 1, further comprising a pin cover pivotally attached to the club holder lower base and configured to cover at least part of the pins in a first position and to pivot away from the pins to a second position for inserting the pins into the ground.

6. The golf club carrier of claim 1, wherein said handle includes a handle grip, a handle base, and an intermediary handle support connecting said handle grip to said handle base.

7. The golf club carrier of claim 6, wherein said handle base is a short hollow tube with an inner surface and an outer surface, and said handle base includes notched flexible fasteners adapted to accept and maintain said club holder upper base.

8. The golf club carrier of claim 1, wherein the hollow central tube of said club holder lower base has an inner surface and an outer surface, and said inner surface of said hollow central tube has one or more protrusions located thereon used to maintain golf balls inside said hollow central tube.

9. The golf club carrier of claim 8, wherein said hollow central tube has an opening located on the side thereof.

10. The golf club carrier of claim 5, wherein said pin cover includes a pin cover base, a pin cover hook extending therefrom and adapted to hook onto said club holder lower base, and means for selectively locking said pin cover base against said pins.

* * * * *